United States Patent [19]

Gherardi

[11] Patent Number: 4,699,033

[45] Date of Patent: Oct. 13, 1987

[54] DEVICE FOR DIVIDING A CONTINUOUS WEB OF WRAPPING MATERIAL INTO SUCCESSIVE SINGLE SECTIONS

[75] Inventor: Gian L. Gherardi, Medicina, Italy

[73] Assignee: Sasib S.p.A., Bologna, Italy

[21] Appl. No.: 843,174

[22] Filed: Mar. 24, 1986

[30] Foreign Application Priority Data

Mar. 27, 1985 [IT] Italy ..... 12463 A/85

[51] Int. Cl.[4] ..... B26D 1/40; A24C 5/58

[52] U.S. Cl. ..... 83/348; 83/346; 83/663; 83/677

[58] Field of Search ..... 83/152, 346, 348, 663, 83/677

[56] References Cited

U.S. PATENT DOCUMENTS

| | | | |
|---|---|---|---|
| 2,252,733 | 8/1941 | Sherman et al. . | |
| 2,582,522 | 1/1952 | Battersby . | |
| 2,747,634 | 5/1956 | Klemm et al. . | |
| 3,209,633 | 10/1965 | Doerman | 83/348 X |
| 3,499,370 | 3/1970 | Kulwicki et al. | 83/348 X |
| 3,771,399 | 11/1973 | Aterianus . | |
| 3,823,634 | 7/1974 | Rod et al. . | |
| 4,010,666 | 3/1977 | Masters . | |
| 4,270,910 | 6/1981 | Himmelsbach | 83/152 X |
| 4,366,737 | 1/1983 | Bedford | 83/677 X |
| 4,370,908 | 2/1983 | DeAlto et al. | 83/348 |

FOREIGN PATENT DOCUMENTS

| | | | |
|---|---|---|---|
| 2019320 | 11/1971 | Fed. Rep. of Germany | 83/152 |
| 934295 | 8/1963 | United Kingdom | 83/348 |
| 1352677 | 5/1974 | United Kingdom | 83/697 |
| 1469684 | 4/1977 | United Kingdom | 83/348 |

*Primary Examiner*—E. R. Kazenske
*Assistant Examiner*—Eugenia A. Jones
*Attorney, Agent, or Firm*—Spencer & Frank

[57] ABSTRACT

The invention refers to the devices for dividing a continuous web of wrapping material into successive single sections of a same length. These devices comprise a rotary cutting roller (1) with one or more angularly equispaced peripheral radial blades (7), the cutting edge of which is parallel to the axis of shaft (6) for driving in rotation the said cutting roller (1), and a rotary counter-roller (19) having one or more peripheral anvils (18) that cooperate each with a blade (7) on the cutting roller (1). According to the invention, the blade or blades (7) are each secured to a projecting blade-carrying member (8) which by elastic deformation is elastically yieldable in the radial direction toward the axis of shaft (6) for driving in rotation the cutting roller (1).

5 Claims, 12 Drawing Figures

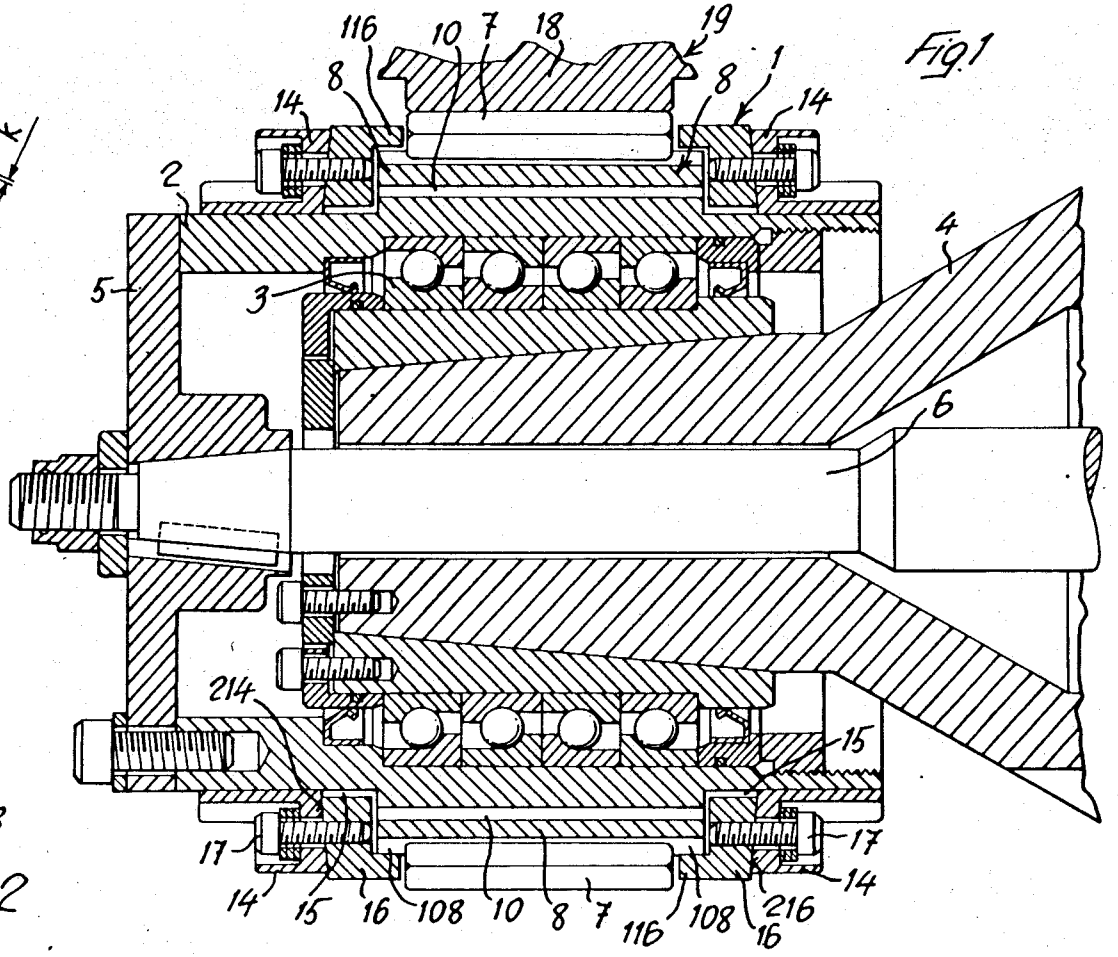
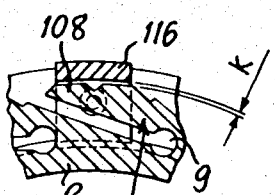
Fig.3
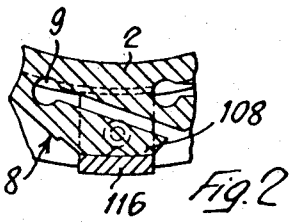
Fig.2

DEVICE FOR DIVIDING A CONTINUOUS WEB OF WRAPPING MATERIAL INTO SUCCESSIVE SINGLE SECTIONS

BACKGROUND OF THE INVENTION

The invention refers to the devices for dividing a continuous web of wrapping material into successive single sections of a same length, particularly for dividing a web of wrapping material into successive single bands used in the manufacture of filter-tipped cigarettes, which device comprises a rotary cutting roller with one or more angularly equispaced peripheral radial blades, the cutting edge of which is parallel to the axis of the shaft for driving in rotation the said cutting roller, and a rotary counter-roller having one or more peripheral anvils that cooperate each with one blade on the cutting roller, and which is possibly provided with suction ports for holding onto the counter-roller the single sections cut from the web fed around the counter-roller.

In these devices, the cutting of the web is effected by parting it off, that is to say, the web is simultaneously engaged over its entire width by the cutting edge of each blade on the cutting roller, and by one blow it is cut off against the respective anvil on the counter-roller. The cadenced blows of the cutting roller blades on on the counter-roller anvils produce noise and vibrations.

To obviate to this inconveniences, devices of the above disclosed type have been proposed, in which the blades are not fixedly secured to the cutting roller, but are so mounted as to be radially slidable thereon between lateral guide walls, and as to be urged radially outward as far as an abutment stop member by return helical or cup springs which allow an elastic retraction of each blade when the blade hits against the associated anvil, in order to reduce the noise and dampen the vibrations. This solution however presents some other inconveniences. In fact, so-called fretting phenomena occur, that is to say, abrasion or corrosion phenomena due to friction, which affect above all the springs and in a short time annihilate their efficiency. To replace the springs with special elastomers is not the best solution of the problem, since these materials although being capable to maintain their elastic properties at the high temperatures produced by the deformation work, allow only small elastic retractions of the blades. Moreover, the slidable embodiment of the blades involves a considerably complicated construction, while the tobacco dust may penetrate between the guide surfaces, whereby the sliding of the blades is made difficult.

A further inconvenience of the known cutting devices of the above disclosed types resides in a quick and irregular wear of the blade cutting edges due to any inevitable inexactness in positioning the blades with respect to the associated anvils on the counter-roller. In fact, each blade generally hits against the associated anvil at first with one end and then with the entire length of its cutting edge, which will be very soon the cause of defective cuts. To obviate such an inconvenience, it is known to use blades which are tiltable in radial planes passing through the axis of the cutting roller. At the same time, each blade is elastically loaded in the longitudinal direction by means of elements sliding along both sides of the blade.

The said sides of the blade are oblique sides which converge in the outward direction, and at the first cut the elastic load acting thereupon puts the blade straight, so that it is definitely arranged when its cutting edge is not initially parallel to the surface of the respective anvil. The construction of these devices however is a very complicated one.

SUMMARY OF THE INVENTION

The invention aims to eliminate the aforementioned inconveniences by reducing the excessive noise of the cutting devices of the type as disclosed at the beginning, and preventing any movements between the contacting surfaces, as well as the premature wear of the blades, resulting from a defect of parallelism of the blades to the associated anvils.

This aim is attained by the invention in that the blade or blades are each secured onto a projecting blade-carrying member which by elastic deformation is elastically yieldable in the radial direction toward the axis of the shaft for driving in rotation the cutting roller. The said projecting blade-carrying member can be either made of one piece with the cutting roller skirt, or it may be added and rigidly secured thereto.

The elastic radial yieldability of the projecting blade-carrying members considerably reduces any noise produced by the blades hitting against the respective anvils. The elastic radial yielding of the blades however occurs through a corresponding elastic deformation of the projecting blade-carrying member, whereby any relative movement between the contacting surfaces, and any movement of the lateral guides, is prevented, so that all the inherent inconveniences are eliminated. Moreover, the projecting blade-carrying members have a limited resistance to torsional stress, so that they can be twisted in such a manner as to amend any defect of parallelism between the cutting edges of the blades and the associated anvil.

Subordinately, the invention provides a particular method of assembling the cutting devices of the above disclosed type, having projecting blade-carrying members.

The features of the invention and the advantages arising therefrom will appear more in detail in the following specification of one preferred embodiment thereof, shown by way of a non-limiting example in the accompanying drawings, in which:

BRIEF DESCRIPTION OF THE DRAWINGS

FIG. 1 is an axial sectional view of the cutting roller.

FIG. 2 is a cross-sectional view of a projecting blade-carrying member in rest condition.

FIG. 3 is a cross-sectional view of a projecting blade-carrying member at the moment in which the respective blade hits against the associated anvil.

FIGS. *7a* and *7b* are cross-sectional views of two projecting blade-carrying members with two additional damping elements.

Figure 10:
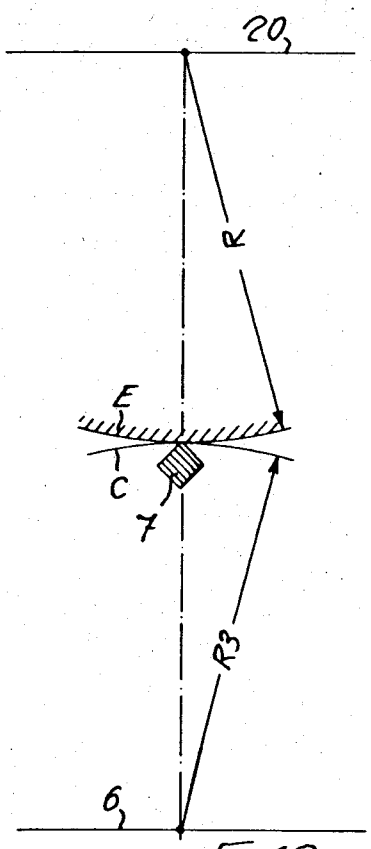
Figure 9:
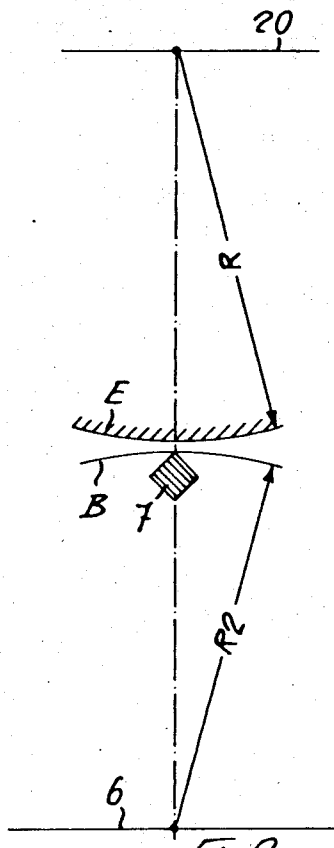
Figure 8:
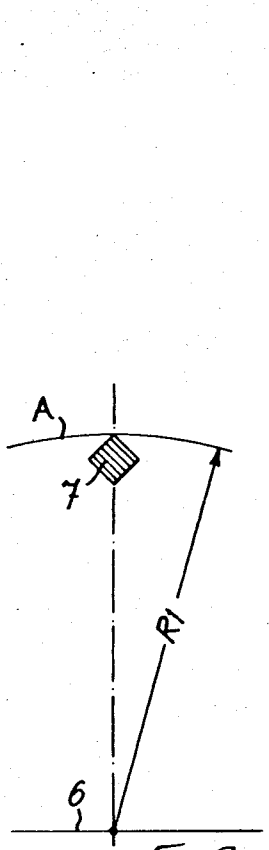

FIGS. 8 to 10 diagrammatically show some successive steps of adjusting the blade-carrying members at the time of their assembly.

DESCRIPTION OF THE PREFERRED EMBODIMENT

In the Figures, numeral 1 denotes the cutting roller unit of a device for dividing a continuous web of wrapping material into successive single sections of a same length. The cutting roller 1 comprises a cylindrical skirt 2 which through bearings 3 is mounted onto a cantilevered fixed support 4.

The skirt 2 has its outward end secured to a disk 5 which in turn is secured to a driving shaft 6 rotatably mounted in support 4.

On its periphery, the cutting roller 1 carries a plurality of blades 7 which are parallel to the axis of skirt 2 and are set in an angularly equispaced relation. Each blade 7 is fastened to a projecting blade-carrying member 8 which is elastically yieldable in the radial direction.

In the preferred embodiment, the projecting blade-carrying members 8 are made of one piece with the skirt 2 of the cutting roller 1, and are formed by making in an outward raised portion of the said skirt 2 angularly equispaced through bores 9 which are parallel to the axis of the shaft for driving in rotation the cutting roller 1. Starting from each bore 9, an inclined slit 10 is drilled in such a manner as to pass outwardly of the next bore 9, at some distance therefrom. Thus, each blade-carrying member 8 is given the shape of a projecting cleat-like member which is capable to elastically swing in the radial direction, more easily as its cross-section at the bore 9 is thinner. The elastic deformability and particularly the twist of each blade-carrying member 8 can be increased by locally making bores or slots for conveniently reducing the resistance to torsional stress of the cross-section of the blade-carrying member 8 at its base, in correspondence of the respective bore 9.

On its outward side, each blade-carrying member 8 is provided with a housing for seating therewithin the respective blade 7, that has a square profile with four cutting edge. It is then possible to change the active cutting edge of blade 7 by inserting in a different angular position the blade 7 into the respective housing in the blade-carrying member 8.

Figure 6:
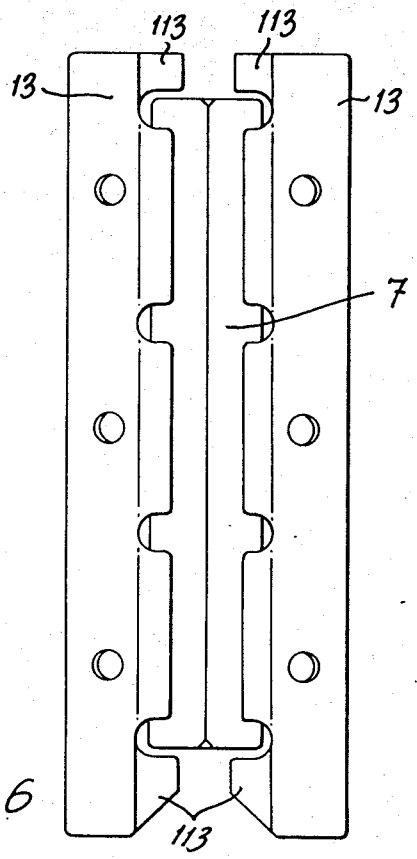
FIG. 6 is a top view of the blade according to FIG. 5.
Figure 4:
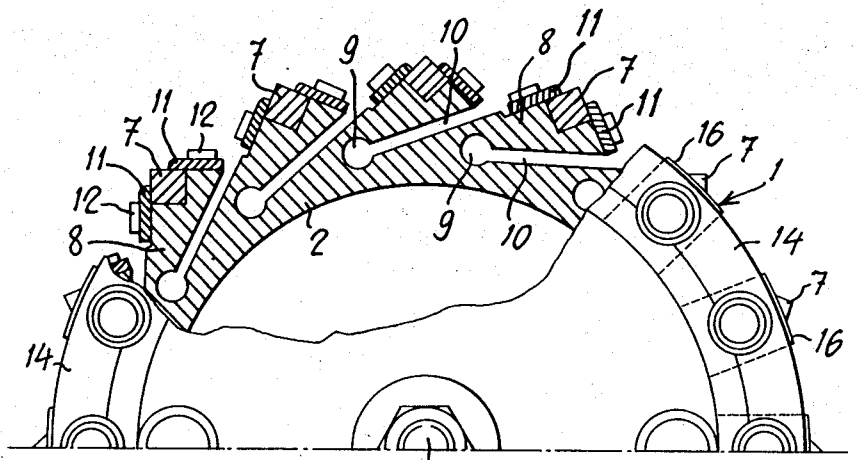
FIG. 4 is a cross-section through one half of the cutting roller.
Figure 5:
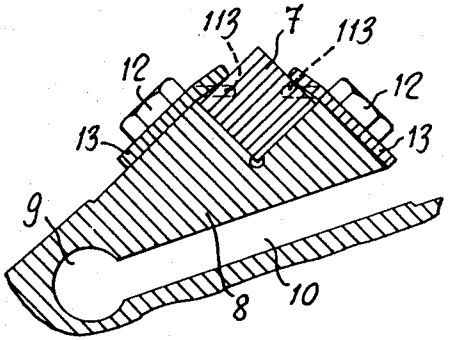
FIG. 5 is a cross-sectional view of a blade and the respective blade-carrying member, which shows a preferred embodiment of fastening the blade to the blade-carrying member.
Figure 7A:
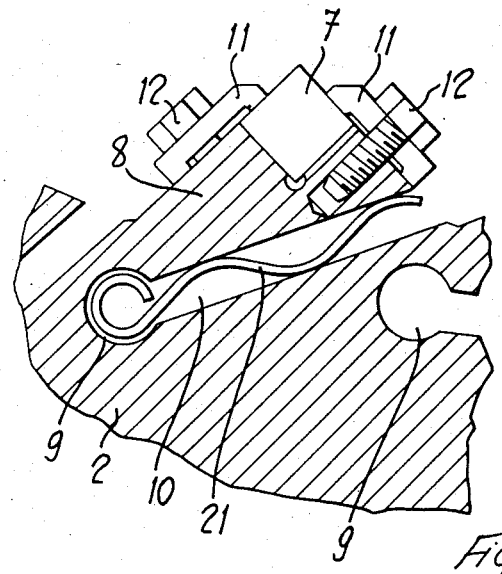
Figure 7B:
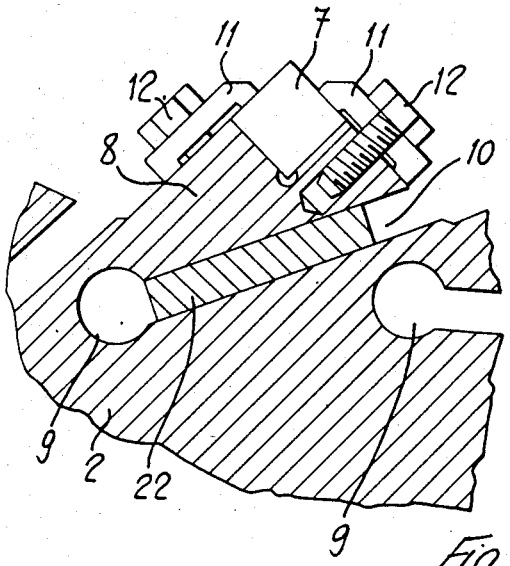

Each blade 7 can be fastened to the respective blade-carrying member 8 by means of two clamping rigid stirrups 11 which through screws 12 are secured to the blade-carrying member 8, and partially overlap the blade 7, as shown in FIG. 4, and in FIGS. *7a* and *7b*. Preferably, however, in place of the rigid stirrups 11, two resilient platelets 13 are used for fastening the blades 7 to the respective blade-carrying member 8, as shown in FIGS. 5 and 6. These resilient platelets 13 afford the advantage that it is not required to unloose any screws for removing and fitting in again a blade 7. Actually, when the platelets 13 are used, blade 7 can be drawn in its longitudinal direction out of the respective housing in the projecting blade-carrying member 8 by exerting a proper effort with a suitable implement. At their ends, the resilient clamping platelets 13 may present tabs 113 to be set into abutment with the head ends of blade 7. When fitting in or drawing out a blade 7, these abutment tabs 113 are elastically lifted so as to permit the passage of the blade.

The radial outward movement of each projecting blade-carrying member 8 is limited by preferably adjustable abutment stop members. In the shown embodiment, on each side of the median raised portion of the skirt 2 of the cutting roller 1, from which side the projecting bladecarrying members 8 are made by means of bores 9 and slits 10, there is secured a ring 14 which in correspondence of each projecting blade-carrying member 8 has an indentation 15 in its side turned toward the said projecting bladecarrying member 8. In each indentation 15 there is housed an abutment block 16 with its projecting stop portion 116 overlapping the matching end 108 of the projecting bladecarrying member 8. Preferably, the projecting portion 116 of the abutment block 16 is shaped like a cylinder segment, and the matching end 108 of the blade-carrying member 8 is cylindrical on its outer side. Each abutment block 16 can be adjusted in the radial direction, so as to alter the outermost radial position of the respective projecting blade-carrying member 8. To this end, in the shown embodiment each abutment block 16 has an inclined outward side 216 which bears against the correspondingly inclined inward side 214 of ring 14. The abutment block 16 is also freely shiftable in the radial direction and can be locked in position by means of a locking screw 17 which is passed with radial play through a respective bore in ring 14 and is screwed in the abutment block 16. By unloosening the locking screw 17, the abutment block 16 can be freely shifted in the radial direction together with the screw 17. By tightening the screw 17, the abutment block 16 is clamped against the ring 14 and is locked by a wedge effect due to the cooperating inclined surfaces 214, 216.

Each blade 7 of the cutting roller 1 cooperates in known manner with a respective peripheral anvil 18 of a counter-roller 19 on which the web to be divided into successive single sections is fed. The cutting of this web is effected by parting it off from above, through the action of the cutting edge of each blade 7 hitting against the respective anvil 18 on the counter-roller 19. to adjust the blades 7 in their proper position when assembling the cutting roller 1, it should be proceeded as follows.

When in their initial rest condition, the cutting edges of blades 7 lie on an ideal circle A having a radius R1, as shown in FIG. 8. Before assembling the cutting roller, the blade-carrying members 8 are radially loaded by the aid of a special implement, so as to deflect them toward the axis of the cutting roller 1, and as to bring the cutting edges of blades 7 on an ideal circle B having a radius R2 which is smaller than the radius R1, as shown in FIG. 9. The blade-carrying members 8 are kept in this position by the respective adjustable abutment blocks 16. The radius R2 of circle B is such that after the subsequent assembly of the cutting roller 1, the blades 7 do not contact the anvil 18 provided on the counter-roller 19, and which lie on a circle E having a radius R.

After the assembly of the cutting roller 1, a blade 7 is moved in front of the relative anvil 18 on the counter-roller 19, and the respective blade-carrying member 8 is unlocked by means of the abutment blocks 16. The blade-carrying member 8 is partly unloaded, so that it elastically moves radially outward, as far as to cause the cutting edge of its blade 7 to bear against the anvil 18 on the counter-roller 19, as diagrammatically shown in FIG. 10. Thanks to the capability of the blade-carrying member 8 to twist elastically, the respective blade 7 bears throughout the length of its cutting edge against the anvil 18 on the counter-roller 19, whereby any inevitable defect of parallelism is amended.

After this operation, the cutting edge of blade 7 comes to lie on a circle C, the radius R3 of which is greater than the former radius R2, but is smaller than the initial radius R1 corresponding to its rest condition. Such a position of blade 7 is "stored", that is to say, is predetermined by means of the abutment blocks 16 which are adjusted and locked in a position in which their projecting portions 116 bear against the cylindrical outward surfaces 108 of the blade-carrying member 8, as it appears in FIG. 2 and in the lower portion of FIG. 1.

Figure 11:
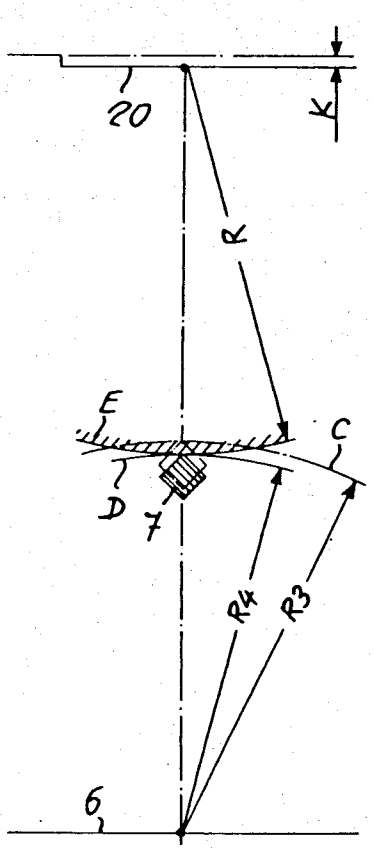

The said operations are carried out for all the blade-carrying members 8 on the cutting roller 1. Then the distance between the shaft 6 of the cutting roller 1 and the shaft 20 of the counter-roller 19 is altered by means of an adjusting conventional eccentric device (not shown) and, more particularly, it is reduced to an amount K in such a manner that the cutting edge of a blade 7 bearing against its respective anvil 18 on the counterroller 19 comes to lie, owing to the elastic radial yielding of the respective blade-carrying member 8, on an ideal circle D of a radius R4 which is smaller than the radius R3 by the said amount K, as shown in FIG. 11. This difference K between the two radiuses R3 and R4 is the interference between the cutting edge of blade 7 and the respective anvil 18, which guarantees an excellent cutting action. During the operation, the blade-carrying members 8 are kept by the respective abutment blocks 16 in the position in which the edges of blades 7 lie on the circle C having a radius R3, as shown in FIGS. 2 and 10. Any time a blade 7 hits with its cutting edge against the anvil 18 on the counter-roller 19, the respective blade-carrying member 8 elastically yields radially by the amount K, as shown in FIGS. 3 and 11.

If need be, but not necessarily, the projecting blade-carrying member 8 may be supported radially by suitable resilient damping supports inserted into the slits 10 and consisting, for example, of springs 21 or of blocks 22 of an elastomer material, as shown in FIGS. *7a* and *7b*, respectively.

I claim:

1. A device for dividing a continuous web of wrapping material into individual successive sections of equal length, said device comprising:

a drive shaft having an axis about which said shaft is rotatable;

a rotary cutting roller mounted on said shaft for rotation therewith and having a cylindrical skirt which is concentric to the axis of said shaft, said cylindrical skirt having an outer periphery, a bore spaced inwardly from said outer periphery and extending parallel to the axis of said shaft, and a slit extending from said outer periphery to said bore and inclined to a radial plane passing through the axis of said shaft and through said bore so that said skirt has an integral portion which is located radially outwardly of said slit, is elastically yieldable in the direction toward the axis of said shaft and constitutes a blade-carrying member having two axial ends spaced apart in a direction parallel to the axis of said shaft;

at least one cutting blade fastened to said blade-carrying member and having a cutting edge which protrudes radially outwardly from said blade-carrying member and extends parallel to the axis of said shaft;

a rotary counter-roller having at least one peripheral anvil disposed to cooperate with said cutting blade for dividing a web of wrapping material when such web is disposed between said roller and said counter-roller;

two locking rings fixed to said roller and each disposed adjacent a respective axial end of said blade-carrying member;

two abutment stop members each associated with a respective axial end of said blade-carrying member, each stop member having an axial extension overlying a respective axial end of said blade-carrying member and being radially displaceable for contacting said blade-carrying member and limiting the radial outward displacement thereof; and two locking screws each securing a respective abutment stop member to a respective locking ring; wherein each said abutment stop member and each said locking ring has an inclined surface, and said inclined surface of each said abutment stop member bears against said inclined surface of a respective locking ring to produce a wedging action therebetween.

2. A device as defined in claim 1 wherein: said blade-carrying member is formed to have a housing in which said cutting blade is disposed; said device further comprises two resilient platelets having spaced portions which overlap respective opposite sides of said blade, and means for fastening said platelets to said blade-carrying member; and said platelets are constructed for permitting said blade to be displaced parallel to the axis of said drive shaft for removal from and introduction in to said housing without displacing said fastening means.

3. A device as defined in claim 1 wherein said blade-carrying member is provided with at least one opening permitting said blade-carrying member to be elastically twisted.

4. A device as defined in claim 3 wherein said opening is a bore.

5. A device as defined in claim 3 wherein said opening is a slot.

* * * * *